US005739485A

United States Patent [19]

Cholet et al.

[11] Patent Number: 5,739,485

[45] Date of Patent: Apr. 14, 1998

[54] MOTOR VEHICLE EXHAUST MUFFLER

[75] Inventors: Vincent Cholet, Metz; Gilbert Duboueix, Saint Nom la Breteche; Philippe Guesdon, Paris; Dominique Spehner, Sedan, all of France

[73] Assignee: Sollac, Puteaux, France

[21] Appl. No.: 772,272

[22] Filed: Dec. 20, 1996

[30] Foreign Application Priority Data

Dec. 20, 1995 [FR] France ..... 95 15087

[51] Int. Cl.[6] ..... F01N 7/18

[52] U.S. Cl. ..... 181/282; 181/244

[58] Field of Search ..... 181/282, 244, 181/245, 272; 420/104; 428/433, 457

[56] References Cited

U.S. PATENT DOCUMENTS

| | | | |
|---|---|---|---|
| 4,141,724 | 2/1979 | Brickner et al. | 420/104 |
| 4,254,684 | 3/1981 | Allegra et al. | 428/653 |
| 4,260,662 | 4/1981 | Wratil | 428/433 |
| 4,382,487 | 5/1983 | Baumann | 181/282 |

FOREIGN PATENT DOCUMENTS

| | | |
|---|---|---|
| A-O 007 131 | 7/1978 | European Pat. Off. . |
| A-0 434 849 | 7/1991 | European Pat. Off. . |
| A-2 078 273 | 2/1971 | France . |
| U-93 18 921 | 3/1994 | Germany . |
| 1275736 | 11/1989 | Japan . |
| 4154919 | 5/1992 | Japan . |

*Primary Examiner*—Khanh Dang

*Attorney, Agent, or Firm*—Oblon, Spivak, McClelland, Maier & Neustadt, P.C.

[57] ABSTRACT

The invention relates to an exhaust muffler for a motor vehicle, consisting of an external casing (1), an internal casing (2) and a central part (3) consisting of perforated tubing (4) and transverse partitions (5) assembled together to form a chicane, called the insides. The central part (3) is made of an enameled steel, the steel having the following composition in thousandths of a percent by weight:

carbon between 0 and 100 manganese between 0 and 500 phosphorus between 0 and 30 sulfur between 0 and 40 aluminum between 0 and 60 titanium between 0 and 200 copper between 0 and 60 nitrogen between 0 and 15, the remainder being iron and residual impurities, said steel being obtained by hot rolling at a final rolling temperature exceeding the $Ar_3$ point to obtain a strip, which is coiled at a temperature higher than 600 degrees Celsius and, after cold rolling, is subjected to a recrystallization annealing.

20 Claims, 1 Drawing Sheet

MOTOR VEHICLE EXHAUST MUFFLER

BACKGROUND OF THE INVENTION

1. Field of the Invention

The present invention relates to an exhaust muffler for an internal combustion engine, preferably for use on a motor vehicle. Preferably, the invention exhaust muffler comprises an external casing, an internal casing and a central part comprising perforated tubing and transverse partitions assembled together to form a chicane, called the insides. The steel used in the invention muffler is also part of the invention.

2. Discussion of the Background

The central part of exhaust mufflers, and their internal casing, must stand up to highly acidic and highly basic attacks by condensates which are formed in the course of use when the burnt gases from the combustion engine are expanded therein. In fact, traveling in an exhaust muffler there typically are condensates which regularly change from a pH equal to 2 to a pH equal to 12, depending on the use of the engine.

Accordingly, in order to have the ability to withstand corrosion due to attacks of this type, it is known to produce exhaust mufflers in which at least the central part and the internal casing are made of stainless steel.

The major disadvantage of this type of exhaust muffler lies in its high cost, because of the high cost of stainless steel.

To reduce this cost, one solution would be to produce exhaust mufflers in which the central part is made of enameled steel. However, the bulk enamels of the common type unfortunately have a number of disadvantages.

On the one hand, there are problems of adhesiveness, in particular with respect to the sharp edges of the central part and, above all, the edges of the holes in the perforated tubing of which said central part consists. On the other hand, surface defects, known as "fish scale defects" are frequently encountered, which take the form of small semicircular marks where the enamel has been torn away. Finally, a problem of insufficient heat resistance is encountered. Because of the annealing effect to which the central part of the exhaust muffler is subjected in operation, small blisters appear in the overheated regions of the enamel. This phenomenon is also called a "rebubbling effect".

To overcome these disadvantages it is known to employ special enamels which are sufficiently heat-resistant, which do not exhibit the known "annealing effect" and which do not exhibit cracking as a result of changes in temperature.

For example, European Patent No. 007 131 describes such a particular type of enamel, the manufacture and the use of which are found to be complex and therefore entail an added cost when compared with the use of standard enamels.

In addition, in some cases it is appropriate to perform several different baking operations on these enamels to stabilize them.

The implementation of these specific processes is relatively complex and results in a significant added cost and, as a result, such an exhaust muffler, the central part of which is enameled with enamel of this type, is not competitive when compared with an exhaust muffler in which the central part is made of stainless steel.

SUMMARY OF THE INVENTION

The present invention provides an exhaust muffler which resists severe attacks by condensates which are formed in its central part, and which is low in cost.

The subject-matter of the present invention is an exhaust muffler, preferably a motor vehicle exhaust muffler, comprising an external casing, an internal casing and a central part comprising perforated tubing and transverse partitions assembled together to form chicanes, in which least the central part is made of an enameled steel, the steel preferably having the following composition in thousandths of a percent by weight:

carbon between 0 and 100
manganese between 0 and 500
phosphorus between 0 and 30
sulfur between 0 and 40
aluminum between 0 and 60
titanium between 0 and 200
copper between 0 and 60
nitrogen between 0 and 15,
the remainder being iron and residual impurities, said steel preferably being obtained by hot rolling at a final rolling temperature exceeding the $Ar_3$ point to obtain a strip, which is coiled at a temperature higher than 600 degrees Celsius and, after cold rolling, is subjected to a recrystallization annealing.

According to other preferred characteristics of the invention which may be present independently or together, the internal casing is also made of enameled steel, the steel having the following composition in thousandths of a percent by weight:

carbon between 0 and 100
manganese between 0 and 500
phosphorus between 0 and 30
sulfur between 0 and 40
aluminum between 0 and 60
titanium between 0 and 200
copper between 0 and 60
nitrogen between 0 and 15,
the remainder being iron and residual impurities, said steel preferably being obtained by hot rolling at a final rolling temperature exceeding the $Ar_3$ point to obtain a strip, which is coiled at a temperature higher than 600 degrees Celsius and, after cold rolling, is subjected to a recrystallization annealing;

the steel of which the central part or the internal casing consists has the following composition in thousandths of a percent by weight:

carbon between 0 and 4
manganese between 150 and 400
phosphorus between 10 and 15
sulfur between 15 and 40
aluminum between 10 and 50
titanium between 0 and 10
copper between 20 and 30
nitrogen between 1.5 and 7.5,
the remainder being iron and residual impurities, said steel preferably being obtained by hot rolling at a final rolling temperature exceeding the $Ar_3$ point to obtain a strip, which is coiled at a temperature higher than 700 degrees Celsius and, after cold rolling, is subjected to a recrystallization annealing;

the strip is coiled at a temperature higher than 750 degrees Celsius;

the recrystallization annealing is an annealing on expanded coil.

According to another embodiment, the steel of which the central part or the internal casing consists has the following composition in thousandths of a percent by weight:

carbon between 0 and 10 manganese between 150 and 400 phosphorus between 0 and 20 sulfur between 10 and 30 aluminum between 10 and 50 titanium between 50 and 150 copper between 10 and 60 nitrogen between 5 and 15, the remainder being iron and residual impurities, said steel preferably being obtained by hot rolling at a final rolling temperature exceeding the $Ar_3$ point to obtain a strip, which is coiled at a temperature higher than 600 degrees Celsius and, after cold rolling, is subjected to a recrystallization annealing; and may include some or all of the following:

the strip is coiled at a temperature higher than 700 degrees Celsius;

the external casing is made of aluminized steel;

the external casing is made of stainless steel;

the internal casing is made of stainless steel.

These preferred embodiments may also be used with all other aspects of the invention.

The characteristics and advantages of the invention will appear more clearly following the description which is to follow, given solely by way of example and made with reference to the attached drawing, representing a diagrammatic sectional view of a motor vehicle exhaust muffler.

Figure 1:
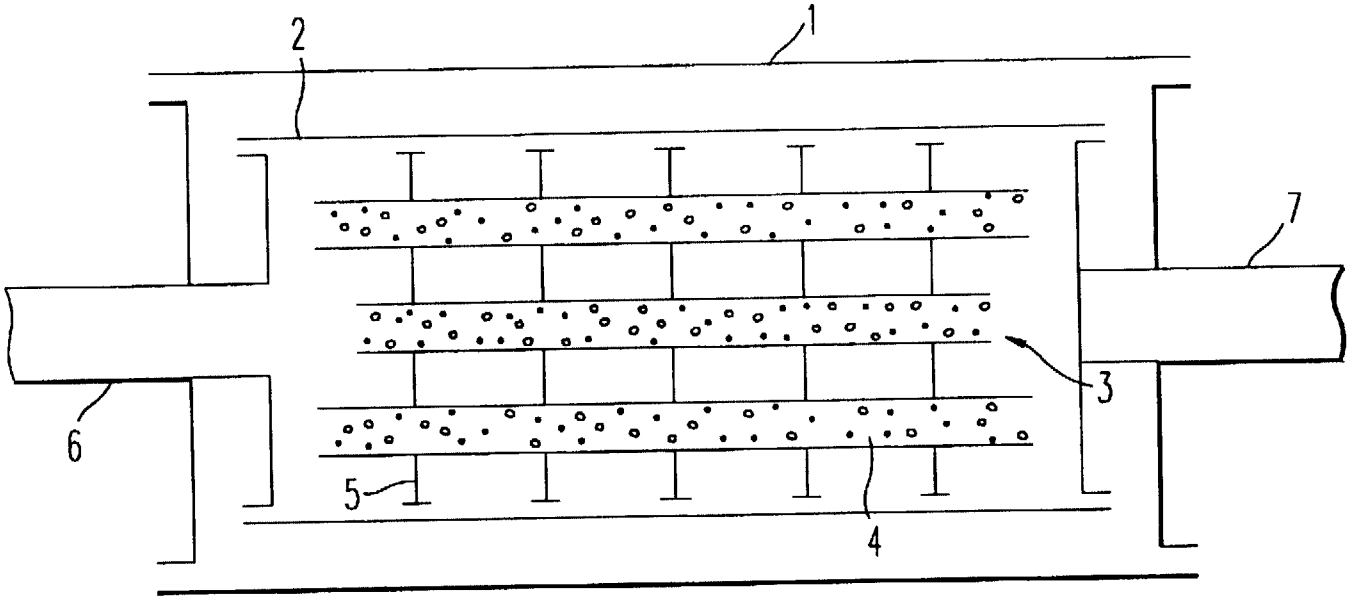
FIG. 1 shows an exhaust muffler comprising an external casing 1, an internal casing 2 and a central part 3.

The central part 3 in FIG. 1 comprises perforated tubing 4 and transverse partitions 5 assembled together to form a chicane enabling the burnt gases from the combustion engine of the motor vehicle to be expanded.

The exhaust muffler in the Figure also includes an entry pipe 6, connecting the latter to the exhaust manifold of the engine and an exit pipe 7 enabling the expanded exhaust gases which have been freed from a certain quantity of harmful particles to be discharged towards the atmosphere.

The central part 3 of the exhaust muffler according to the invention is preferably made of an enameled steel, the steel preferably having the following composition in thousandths of a percent by weight:

carbon between 0 and 100 manganese between 0 and 500 phosphorus between 0 and 30 sulfur between 0 and 40 aluminum between 0 and 60 titanium between 0 and 200 copper between 0 and 60 nitrogen between 0 and 15, the remainder being iron and residual impurities.

The steel is preferably obtained by hot rolling at a final rolling temperature exceeding the $Ar_3$ point to obtain a strip, which is coiled at a temperature higher than 600 degrees Celsius and, after cold rolling, is subjected to a recrystallization annealing which may be either a low annealing under cover or a continuous annealing.

The coiling temperature of the strip is preferably higher than 700 degrees Celsius.

The inventors have found that the use of such a steel for producing the central part 3 of an exhaust muffler allows this central part to be enameled with a high temperature-resistant bulk enamel of any standard type while employing a standard enameling process, that is to say, for example, merely by immersing the central part of the exhaust muffler produced with such a steel in a bath of liquid enamel and in then subjecting the coated central part 3 to a single annealing for baking the enamel, all this preferably being done while eliminating the appearance of the "fish scale defect".

DESCRIPTION OF THE PREFERRED EMBODIMENTS

It has been discovered that conforming to the coiling temperature, the end of the coiling being performed at a temperature higher than 600 degrees Celsius, preferably higher than 700 degrees Celsius, is very important in order to eliminate the "fish scale defect".

According to a first embodiment of the invention, in order to eliminate the rebubbling effect, or annealing effect, a steel is employed which has the following composition in thousandths of a percent by weight:

carbon between 0 and 4 manganese between 150 and 400 phosphorus between 10 and 15 sulfur between 15 and 40 aluminum between 10 and 50 titanium between 0 and 10 copper between 20 and 30 nitrogen between 1.5 and 7.5, the remainder being iron and residual impurities.

The steel is preferably obtained by hot rolling at a final rolling temperature exceeding the $Ar_3$ point to obtain a strip, which is coiled at a temperature higher than 700 degrees Celsius and, after cold rolling, is subjected to a recrystallization annealing.

The strip coiling temperature is preferably higher than 750 degrees Celsius.

The annealing is a decarburizing base annealing as expanded coil, that is to say an annealing under cover of the coil which is coiled into nonadjoining turns.

In such an annealing the coil with nonadjoining turns is heated under cover under HNx atmosphere to approximately 600 degrees Celsius and then the annealing is continued by subjecting it to a stream of steam.

According to another embodiment of the invention, in order to eliminate the rebubbling effect, a steel is employed which has the following composition in thousandths of a percent by weight:

carbon between 0 and 10 manganese between 150 and 400 phosphorus between 0 and 20 sulfur between 10 and 30 aluminum between 10 and 50 titanium between 50 and 150 copper between 10 and 60 nitrogen between 5 and 15, the remainder being iron and residual impurities.

The steel is obtained by hot rolling at a final rolling temperature exceeding the $Ar_3$ point to obtain a strip, which is coiled at a temperature higher than 600 degrees Celsius and, after cold rolling, is subjected to a recrystallization annealing, base annealing or continuous annealing.

The strip is preferably coiled at a temperature higher than 700 degrees Celsius.

It has been found that the carbon, nitrogen, sulfur and titanium content is particularly important for eliminating the rebubbling effect of the enamel.

Thus, by employing one of the steels such as described above it is possible to produce the central part 3 of an exhaust muffler made of enameled steel which is completely corrosion-resistant and simple to use, by employing an enamel of standard type, while obtaining freedom from the defects related to the rebaking of the enamel and defects of the "fish scale defect" type, and which is low in cost.

The internal casing 2 of the exhaust muffler may be made either of stainless steel or of aluminized steel, as indeed can the external casing 1.

The internal casing 2 of the exhaust muffler can also be made of enameled steel by employing for this purpose a steel from among those described above and by enameling the inner face of said casing 2.

The best compromise between efficiency, that is to say essentially corrosion resistance, and cost, is provided by producing either an exhaust muffler in which the central part 3 and the internal casing 2 are made of enameled steel, the external casing 1 being made of aluminized steel, or an exhaust muffler in which the central part 3 is made of enameled steel, the internal casing 2 is made of stainless steel and the external casing 1 is made of aluminized steel.

EXAMPLES

Two exhaust mufflers were produced with an internal casing 2 made of stainless steel, an external casing 1 made of aluminized steel and a central part 3 made of enameled steel.

The central part 3 of the first exhaust muffler was made of a steel which had the following composition, in thousandths of a percent by weight:

carbon equal to 2
manganese equal to 270
phosphorus equal to 12
sulfur equal to 22
aluminum equal to 18
titanium equal to 1
copper equal to 22
nitrogen equal to 4,
the remainder being iron and residual impurities.

The steel was obtained by hot rolling at a final rolling temperature equal to 890 degrees Celsius to obtain a strip, which was coiled at a temperature equal to 760 degrees Celsius and, after cold rolling, was subjected to a recrystallization annealing as an expanded coil.

This central part 3 was enameled by being immersed in a bath of heat- and corrosion-resistant standard bulk enamel which had the following composition in percent by weight:

| | |
|---|---|
| $SiO_2$ | 54 |
| $ZrO_2$ | 2 |
| $P_2O_5$ | 1 |
| $B_2O_3$ | 14 |
| $Al_2O_3$ | 3 |
| CaO | 4 |
| BaO | 5 |
| $Na_2O$ | 11 |

-continued

| | |
|---|---|
| $K_2O$ | 2 |
| $Li_2O$ | 2 |
| NiO | 1 |
| CoO | 0.5 |
| Cuo | 0.5. |

The central part 3 of the second exhaust muffler was made of a steel which had the following composition in thousandths of a percent by weight:

carbon equal to 2
manganese equal to 200
phosphorus equal to 15
sulfur equal to 20
aluminum equal to 30
titanium equal to 100
copper equal to 40
nitrogen equal to 9,
the remainder being iron and residual impurities.

The steel was obtained by hot rolling at a final rolling temperature equal to 890 degrees Celsius to obtain a strip, which was coiled at a temperature equal to 710 degrees Celsius and, after cold rolling, was subjected to a continuous recrystallization annealing.

This central part 3 was enameled by being immersed in a bath of the same enamel as above.

These two exhaust mufflers successfully passed the corrosion tests, while being of the order of 25 to 30 percent less costly than an exhaust muffler made entirely of stainless steel.

Besides this corrosion aspect and this cost aspect, the use of enameled steels to produce at least the central part of an exhaust muffler, said steel having a composition according to the invention, allows the enameled steel to be guaranteed a good resistance to thermal shock to which it is subjected in use, that is to say that cracking of the enamel is avoided.

This is all the more marked when the steel is decarburized and when it contains titanium.

In other words, the steel containing, in thousandths of a percent by weight, between 0 and 10 of carbon and between 50 and 150 of titanium exhibits a better resistance to thermal shocks than the steel containing, in thousandths of a percent by weight, between 0 and 4 of carbon and between 0 and 10 of titanium, which nevertheless exhibits a very good resistance to thermal shock, better than the standard mild steels.

French patent application 95 15087 filed Dec. 20, 1995 is incorporated herein by reference.

What is claimed as new and desired to be secured by Letters Patent of the United States is:

1. An exhaust muffler comprising an external casing, an internal casing and a central part comprising perforated tubing and transverse partitions which are assembled together to form chicanes, in which at least the central part is made of an enameled steel, wherein the steel has the following composition in thousandths of a percent by weight:

carbon between 0 and 100
manganese between 0 and 500
phosphorus between 0 and 30
sulfur between 0 and 40
aluminum between 0 and 60
titanium between 0 and 200
copper between 0 and 60
nitrogen between 0 and 15, the remainder being iron and residual impurities, said steel being obtained by hot rolling at a final rolling temperature exceeding the $Ar_3$ point to obtain a strip, which is coiled at a temperature higher than 600 degrees Celsius and, after cold rolling, is subjected to a recrystallization annealing.

2. The muffler as claimed in claim 1, wherein the internal casing is also made of enameled steel, the internal casing and central part steel having the following composition in thousandths of a percent by weight:

carbon between 0 and 100 manganese between 0 and 500 phosphorus between 0 and 30 sulfur between 0 and 40 aluminum between 0 and 60 titanium between 0 and 200 copper between 0 and 60 nitrogen between 0 and 15, the remainder being iron and residual impurities, said steel being obtained by hot rolling at a final rolling temperature exceeding the $Ar_3$ point to obtain a strip, which is coiled at a temperature higher than 600 degrees Celsius and, after cold rolling, is subjected to a recrystallization annealing.

3. The exhaust muffler as claimed in claim 1, wherein the central part steel has the following composition in thousandths of a percent by weight:

carbon between 0 and 4 manganese between 150 and 400 phosphorus between 10 and 15 sulfur between 15 and 40 aluminum between 10 and 50 titanium between 0 and 10 copper between 20 and 30 nitrogen between 1.5 and 7.5, the remainder being iron and residual impurities, said steel being obtained by hot rolling at a final rolling temperature exceeding the $Ar_3$ point to obtain a strip, which is coiled at a temperature higher than 700 degrees Celsius and, after cold rolling, is subjected to a recrystallization annealing.

4. The exhaust muffler as claimed in claim 3, wherein the strip is coiled at a temperature higher than 750 degrees Celsius.

5. The exhaust muffler as claimed in claim 3, wherein the recrystallization annealing is an annealing in the form of expanded coil.

6. The exhaust muffler as claimed in claim 1, wherein the central part steel has the following composition in thousandths of a percent by weight:

carbon between 0 and 10 manganese between 150 and 400 phosphorus between 0 and 20 sulfur between 10 and 30 aluminum between 10 and 50 titanium between 50 and 150 copper between 10 and 60 nitrogen between 5 and 15, the remainder being iron and residual impurities, said steel being obtained by hot rolling at a final rolling temperature exceeding the $Ar_3$ point to obtain a strip, which is coiled at a temperature higher than 600 degrees Celsius and, after cold rolling, is subjected to a recrystallization annealing.

7. The exhaust muffler as claimed in claim 6, wherein the strip is coiled at a temperature higher than 700 degrees Celsius.

8. The exhaust muffler as claimed in claim 1, wherein the external casing is made of aluminized steel.

9. The exhaust muffler as claimed in claim 1, wherein the external casing is made of stainless steel.

10. The exhaust muffler as claimed in claim 1, wherein the internal casing is made of stainless steel.

11. The exhaust muffler of claim 1, wherein said muffler is a motor vehicle exhaust muffler.

12. The exhaust muffler of claim 2, wherein said muffler is a motor vehicle exhaust muffler.

13. The exhaust muffler of claim 3, wherein said muffler is a motor vehicle exhaust muffler.

14. The exhaust muffler of claim 4, wherein said muffler is a motor vehicle exhaust muffler.

15. The exhaust muffler of claim 5, wherein said muffler is a motor vehicle exhaust muffler.

16. The exhaust muffler of claim 6, wherein said muffler is a motor vehicle exhaust muffler.

17. The exhaust muffler of claim 7, wherein said muffler is a motor vehicle exhaust muffler.

18. The exhaust muffler of claim 8, wherein said muffler is a motor vehicle exhaust muffler.

19. The exhaust muffler of claim 9, wherein said muffler is a motor vehicle exhaust muffler.

20. The exhaust muffler of claim 10, wherein said muffler is a motor vehicle exhaust muffler.

* * * * *